US006317579B1

(12) United States Patent
Kawagishi

(10) Patent No.: US 6,317,579 B1
(45) Date of Patent: Nov. 13, 2001

(54) TONER RECOVERY DEVICE FOR A PHOTOCOPIER USING A PHOTOCONDUCTIVE DRUM

(75) Inventor: Yuji Kawagishi, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 09/474,262

(22) Filed: Dec. 29, 1999

(30) Foreign Application Priority Data

Jan. 26, 1999 (JP) ..... 11-016898

(51) Int. Cl.[7] ..... G03G 21/10
(52) U.S. Cl. ..... 399/359
(58) Field of Search ..... 399/358–360

(56) References Cited

U.S. PATENT DOCUMENTS

Re. 35,528 * 6/1997 Matsuura et al. ..... 399/358
4,752,805 * 6/1988 Fukae et al. ..... 399/359
5,268,720 * 12/1993 Saitoh et al. ..... 399/360 X
5,327,208 * 7/1994 Matsuo et al. ..... 399/358 X
5,442,430 * 8/1995 Ishii et al. ..... 399/359 X
5,499,090 * 3/1996 Ito et al. ..... 399/359
5,878,317 * 3/1999 Masuda et al. ..... 399/359

FOREIGN PATENT DOCUMENTS 62-26762 * 7/1987 (JP) .

* cited by examiner

*Primary Examiner*—William J. Royer
(74) *Attorney, Agent, or Firm*—Shinjyu Global IP Counselors, LLP

(57) ABSTRACT

An imaging apparatus is disclosed that conveys toner smoothly from its cleaning unit to a toner collector and efficiently recovers toner residual on its photoconductive drum circumferential surface. A toner recovery device for the imaging apparatus is provided with a cleaning unit 34 for removing toner residual on the surface of the photoconductive drum 30, a toner-conveying device 71 for conveying recovered toner, and a developing unit 32 to which the recovered toner is conveyed. The inner circumferential bottom surface of a toner conveyance container 72 for the toner-conveying device 71 slopes downward from the cleaning unit 34 toward the developing unit 32.

2 Claims, 2 Drawing Sheets

TONER RECOVERY DEVICE FOR A PHOTOCOPIER USING A PHOTOCONDUCTIVE DRUM

BACKGROUND OF THE INVENTION

1. Technical Field

The present invention relates to toner recovery devices for imaging apparatus—in particular, to a toner recovery device for an imaging apparatus that forms toner images on the circumferential surface of a photoconductive drum, and by a transfer device transfers the toner image formed on the photoconductive drum circumferential surface onto the face of a sheet.

2. Description of Related Art

With such image-reproducing devices as photocopiers, printers, facsimile devices, a document is loaded on a document plate provided on the upper surface of the device, the document image is irradiated with light, and reading the document image is carried out based upon the light reflected from the document. Based upon the read image, an electrostatic latent image is formed on the surface of the photoconductive drum. The photoconductive drum is charged to a predetermined polarity by a main charger, and is irradiated with light from an exposure means to remove the charge in those portions in accordance with the document image, forming an electrostatic latent image.

The main charger, the exposure means, the developing device, the transfer device, a separation device, and a cleaning unit are disposed surrounding the photoconductive drum.

Toner charged to have the same polarity as the photoconductive drum is stored inside the developing device. In a position contiguous with the developing device and the photoconductive drum, the toner stored within the developing device is adsorbed to the uncharged portions of the photoconductive drum. Consequently, the electrostatic latent image formed on the circumferential surface of the photoconductive drum is rendered visible into a toner image.

Onto a sheet conveyed in between the transfer device and the photoconductive drum, the transfer device through the back surface of the sheet applies a voltage having a reverse polarity to that of the toner, which attracts the toner on the photoconductive drum circumferential surface onto the sheet, transferring the toner image.

The separation device is disposed on the downstream end of the transfer device in the sheet conveyance direction. A separation needle that applies a predetermined voltage may be employed as the separation device, which, so that the sheet does not wind round on the photoconductive drum, is for drawing off the sheet from the backside.

The cleaning unit, which is for removing toner residual on the photoconductive drum circumferential surface, is provided with: a cleaning blade that is brought into contact with the photoconductive drum circumferential surface for scraping off toner; a fur brush for weakening the binding force of the toner on the photoconductive drum circumferential surface; and a toner conveying device that conveys toner stripped from the photoconductive drum circumferential surface to a collector. Installing a toner recovery case within the imaging apparatus and conveying toner removed from the photoconductive drum circumferential surface to the toner recovery case has been suggested. Further, recycling recovered toner by conveying it directly to the developing device and the toner cartridge has also been proposed. In either case, a rotary body termed a "spiral," fitted with screw-shaped wings within a conveyance container configured into a tubular shape is provided, and by rotating the spiral, toner is recovered by conveying it from the cleaning unit to the collector.

Sheet-conveying paths in imaging apparatus are for the most part established in the horizontal direction, in which case the transfer device is set positioned beneath the photoconductive drum. This entails arranging the main charger and the exposure means above the photoconductive drum, and disposing the developing device laterally of the photoconductive drum, and the cleaning unit to the side of the photoconductive drum, opposing the developing device. Consequently, wherein recovery is by directly conveying recovered toner from the cleaning unit to the developing device, the conveyance container will be disposed in roughly the horizontal direction. Herein, toner not conveyed smoothly within the conveyance container risks congesting, and if toner congestion progresses, there is the risk that a so-called spiral lock situation, in which the rotary-driven spiral is halted, will arise. If this situation continues further, toner recovered by the cleaning unit will overflow from inside the conveyance container and the cleaning unit, meanwhile scattering within the apparatus, which puts it out of working order by damaging components for example.

SUMMARY OF THE INVENTION

An object of the present invention is the provision of a toner recovery device for an imaging apparatus that smoothly conveys toner from the cleaning unit to the toner collector, and efficiently recovers toner residual on the circumferential surface of the photoconductive drum.

In connection with the present invention, a toner recovery device for an imaging apparatus for forming toner images on a photoconductive drum circumferential surface and transferring by a transfer device the toner image formed on the circumferential surface of the photoconductive drum to sheet surfaces comprises: a cleaning unit for removing residual toner on the circumferential surface of the photoconductive drum after a toner image is transferred onto the face of a sheet by the transfer device; a recovered-toner conveying device for conveying toner removed from the circumferential surface of the photoconductive drum by the cleaning unit; and a toner collector for storing toner conveyed by the recovered-toner conveying device; wherein a junction between the cleaning unit and the recovered-toner conveying device is positioned higher than a junction between the toner collector and the recovered-toner conveying device.

Accordingly, because the toner recovered by the cleaning unit from the circumferential surface of the photoconductive drum is conveyed via the recovered-toner conveying device to the lower positioned toner collector, it is conveyed smoothly under its own weight, preventing it from congesting within the recovered-toner conveying device.

Hereby, a configuration in which the cleaning unit is positioned above the photoconductive drum, and the toner collector is positioned laterally of the photoconductive drum is enabled.

Further, the toner collector can be the developing device that forms toner images on the photoconductive drum circumferential surface.

Moreover, the toner conveying device can be configured to comprise a toner conveyance container having a hollow interior, arranged from its junction with the cleaning unit to its junction with the toner collector, and a spiral having a screw-shaped periphery, disposed to be rotary-drivable in the hollow interior of the toner conveyance container.

Furthermore the toner conveyance container can be configured to slope from at least its inner circumferential bottom-surface junction with the cleaning unit to its junction with the toner collector, and the angle of inclination can be 10 to 30 degrees.

The foregoing and other objects, features, aspects and advantages of the present invention will become more apparent from the following detailed description in conjunction with the accompanying drawings.

DETAILED DESCRIPTION OF THE PREFERRED EMBODIMENTS

Figure 1:
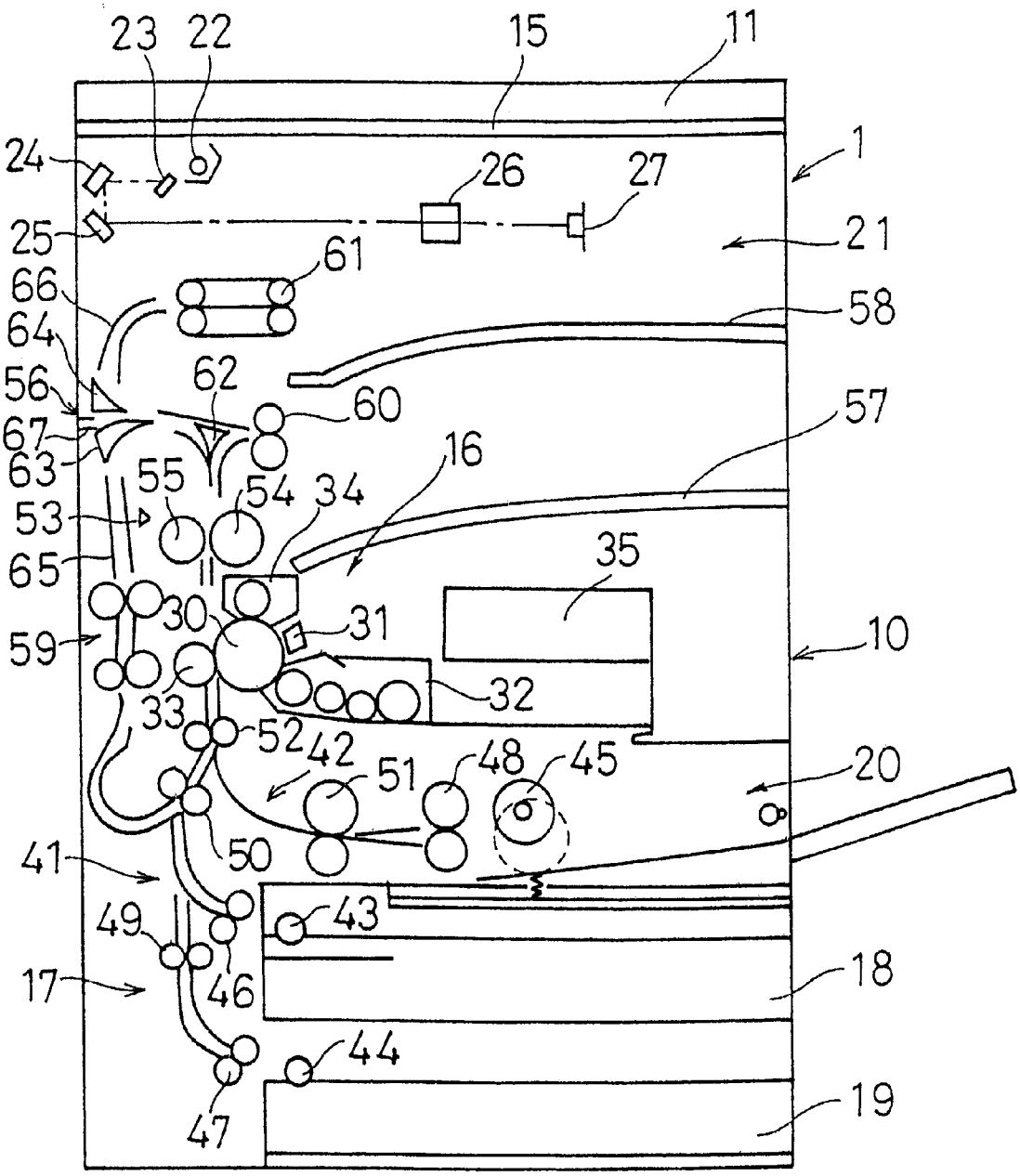
FIG. 1 is a schematic, vertical section view of copying machine in which the invention in a first embodiment is applied.

FIG. 1 illustrates in a vertical section view a copying machine in which the invention is applied in one embodiment.

The copying machine 1 has a main body 10 and a document holder 11 hinge-fitted on the upper part of the main body 10.

Positioned in the upper part of the main body 10 a document plate 15 on which document originals are loaded is arranged. An imaging unit 16 is provided inside the main body 10 on the left-side end viewed from the front and in roughly the center vertically. Moreover, a sheet-supply unit 17 for feeding sheets to the imaging unit 16 is set into the lower part.

The sheet-supply unit 17 is withdrawably installed in the main body 10, and is equipped with sheet-feed cassettes 18, 19 that store sheets, above which a stack bypass 20 is provided.

An optical system 21 for reading image information from document originals loaded on the document plate 15 is provided beneath the document plate 15. The optical system 21 is equipped with: a light source 22 for irradiating light on the face of document originals loaded onto the document plate 15; mirrors 23, 24 and 25 for deflecting light reflected off the face of document originals; a lens 26 for converging light from the mirror 25, and an image pick-up element 27 such as a CCD sensor that receives the light converged by the lens 26 and generates image data signals corresponding to the document original image.

The imaging unit 16 has a photoconductive drum 30 on the surface of which electrostatic latent images are formed, and also has a principal charger 31, a developing unit 32 a transfer roller 33, and a cleaning unit 34 disposed surrounding the photoconductive drum 30.

The principal charger 31 is a device for charging the surface of the photoconductive drum 30 and is arranged diagonally upward to the right of the photoconductive drum 30. The developing unit 32, which forms toner images on the photoconductive drum 30, is arranged diagonally downward to the right of the photoconductive drum 30 at a predetermined gap opening from the principal charger 31. The developing unit 32 interiorly houses toner, and is for rendering the electrostatic latent image formed on the photoconductive drum 30 visible by means of the toner. Further, the transfer roller 33 is a device for transferring toner images on the photoconductive drum 30 to sheets, and is arranged leftward of the photoconductive drum 30. The cleaning unit 34 is a device for removing toner residual on the surface of the photoconductive drum 30 and is disposed above the photoconductive drum 30.

A laser unit 35 is disposed rightward of the photoconductive drum 30 for forming electrostatic latent images on the circumferential surface of the photoconductive drum 30. The laser unit 35 forms electrostatic latent images on the circumferential surface of the photoconductive drum 30 based upon image data signals obtained from the image pick-up element 27.

The sheet-supply unit 17 is equipped with a vertical conveyance path 41 for conveying sheets toward the imaging unit 16 from each of the cassettes 18, 19, and a bypass conveyance path 42 that conveys sheets from the stack bypass 20 toward the imaging unit 16. Pick-up rollers 43, 44, 45 for taking out stored sheets, as well as sheet-feeding roller pairs 46, 47, 48 for sending sheets out one-by-one to the conveyance path, are arranged respectively on the cassettes 18, 19 and the stack bypass 20. Conveyance roller pairs 49 and 50 are arranged in the vertical conveyance path 41, and a conveyance roller pair 51 is disposed in the bypass conveyance path 42. The vertical conveyance path 41 and the bypass conveyance path 42 merge beneath a transfer position in which the photoconductive drum 30 and the transfer roller 33 oppose. In the place in which they are merged, registration rollers 52 are arranged for holding in a predetermined position sheets conveyed there.

A fixing unit 53 for fuse-fixing toner transferred onto sheets is provided above the photoconductive drum 30 and the transfer roller 33. The fixing unit 53 is equipped with a heating roller 54 having a built-in heater and a pressure roller 55 that pressure-contacts the heating roller 54, for pinching and conveying sheets between the two rollers and at the same time thermally fixing toner images formed on the face of the sheets.

A branching section 56 is provided further upward from the fixing unit 53.

Arranged to the right side of the branching section 56 are a discharge tray 57 into which sheets are discharged via a discharge roller pair 60, and a sub-discharge tray 58 into which sheets are discharged via a discharge roller pair 61, disposed above the discharge tray 57. Further, a sheet re-feed section 59 for re-feeding sheets on dual-sided copying occasions is arranged toward the lower left of the branching section 56. A branching claw 62 for switching the sheet conveyance direction between the discharge tray 57 direction and the re-feed section 59 direction is provided in the branching section 56. Two branching claws 63, 64 are provided to the left side of the branching claw 62. A re-feed sheet conveyance path 65 that guides sheets to the sheet re-feed section 59 is provided beneath the two branching claws 63, 64, above which a sub-tray conveyance path 66 is set that guides sheets to the sub-discharge tray 58. Further, a finisher conveyance path 67 that conveys sheets to a not-illustrated finisher, such as a sorter or a stapler-sorter, is provided intermediate the two branching claws 63, 64. The branching claws 63, 64 thus enable switching so as to guide sheets conveyed there into one among the re-feed sheet conveyance path 65, the sub-tray conveyance path 66, or the finisher conveyance path 67.

Toner Conveying System

Figure 2:
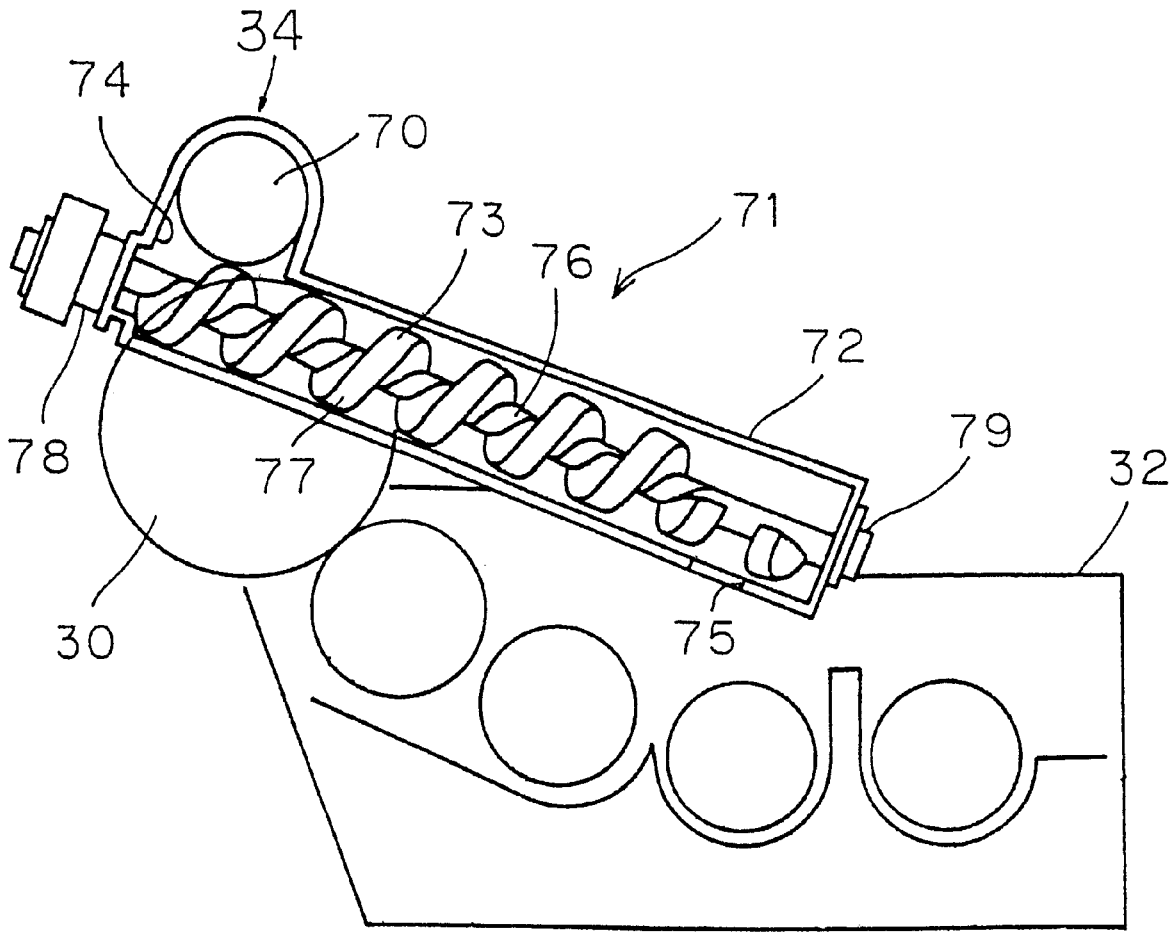
FIG. 2 is a schematic, vertical section view of chief components of a toner-conveying device in accordance with the present invention.

The cleaning unit 34 is for removing toner remaining on the circumferential surface of the photoconductive drum 30. The toner removed form the circumferential surface of the photoconductive drum 30 is conveyed to the developing unit 32 via a toner-conveying device. The toner-conveying device will be explained using FIG. 2.

Furnished in the cleaning unit 34 are a cleaning blade (not illustrated) that pressure-contacts the photoconductive drum 30 circumferential surface for scraping off toner remaining on the circumferential surface of the photoconductive drum 30, and at one end in the width direction, a spiral 70 that conveys toner scraped off by the cleaning blade.

A toner-conveying device 71 is established on the one end in the width direction of the cleaning unit 34. The toner-conveying device 71 is furnished with a tube-shaped toner conveyance container 72 having a hollow interior and a conveying member 73 arranged to be rotatable in the toner conveyance container 72.

The toner conveyance container 72 is provided with an opening 74 that communicates with the cleaning unit 34 on the one end in the width direction, and a discharge port 75 for discharging toner to the developing unit 32. The toner conveyance container 72 is configured such that at least its inner circumferential bottom surface slopes downward from the cleaning unit 34 to the developing unit 32. The angle of inclination of the inner circumferential bottom surface preferably is approximately in a 10–30 degree extent; in this embodiment it is set to approximately 20 degrees.

The conveying member 73 comprises a rotary axle 76, and a contacting element 77 fitted in the form of a screw on the periphery of the rotary axle 76. The contacting element 77 is brush-shaped, being fibers constituted from a synthetic polymer material implanted peripherally around the rotary axle 76, and is set so as to contact the inner wall of the toner conveyance container 72.

Bearings 78, 79, provided at either end lengthwise of the toner conveyance container 72 and rotary-driven by a not-illustrated drive means, support the rotary axle 76.

Residual toner scraped off the circumferential surface of the photoconductive drum 30 by the cleaning blade is conveyed by the spiral 70 to the toner-conveying device 71 end and drops from the opening 74 onto the conveying member 73 within the toner conveyance container 72.

Herein, the conveying member 73 is rotary-driven, and toner conveyed along by the spiral 70 with the rotation of the conveying member 73 is conveyed toward the right in the figure within the toner conveyance container 72, and discharged from the discharge port 75 into the developing unit 32. Because the inner circumferential surface of the toner conveyance container 72 is configured so as to slope downward from the cleaning unit 34 to the developing unit 32 end, recovered toner sent through the hollow interior is conveyed smoothly under its own weight to the developing unit 32 end.

The contacting element 77 on the conveying member 73 is formed into a brush shape from a synthetic polymer material having elasticity, furthermore, and conveys toner while scrubbing the inner wall of the toner conveyance container 72. Accordingly, the tips of the contacting element 77 constantly clean the inner wall of the toner conveyance container 72, which keeps the toner from clinging to the inner wall of the toner conveyance container 72. Further, because the contacting element 77 has elasticity, by rotating it is continuously elastically deformed, making it hard for toner to stick superficially to the contacting element 77, and even if toner does stick, it simply breaks away due to the elastic deformation. Thus stuck toner is kept from forming large clumps that clog the toner conveyance container 72. Accordingly, this prevents the conveying ability of the toner-conveying device 71 from deteriorating.

Inclining the toner conveyance container 72 at a small angle risks toner congesting inside the toner conveyance container 72 and hindering rotary drive of the conveying member 73. Conversely, at too large an angle the recovered toner free-falls and gets collected within the developing unit 32, making it difficult to control the proportions of new toner that a toner cartridge or the like replenishes and recovered toner. Consequently, the angle of inclination of the toner conveyance container 72 is as described earlier preferably set within a range of 10 to 30 degrees.

A spiral composed of a general hard synthetic polymer may also be used for the conveying member 73.

According to the present invention, the junction of the cleaning unit and recovered toner conveying device is positioned higher than the junction of the toner collector and recovered toner conveying device. Therefore, toner recovered from the circumferential surface of the photoconductive drum by the cleaning unit is thus sent via the recovered toner transport device to the toner collector positioned below, conveyed smoothly under its own weight, and preventing it from congesting within the recovered toner conveying device.

Various details of the present invention may be changed without departing from its spirit nor its scope. Furthermore, the foregoing description of the embodiments according to the present invention is provided for illustration only, and not for the purpose of limiting the invention as defined by the appended claims and their equivalents.

What is claimed is:

1. A toner recovery device for an imaging apparatus for forming toner images on a circumferential surface of a photoconductive drum and laterally transferring by a transfer device disposed laterally of the photoconductive drum the toner images formed on the circumferential surface of the photoconductive drum superficially onto sheets conveyed vertically thereto, the toner recovery device for the imaging apparatus comprising:

a cleaning unit positioned above the photoconductive drum for removing toner residue on the circumferential surface of the photoconductive drum after a toner image is transferred onto the face of a sheet by the transfer device;

a recovered-toner conveying device for conveying toner removed by said cleaning unit from the circumferential surface of the photoconductive drum, said recovered-toner conveying device including a toner conveyance container having a hollow interior and arranged from a first junction with said cleaning unit to a second junction with a toner collector, and a spiral having a screw-shaped periphery, said spiral disposed to be rotary-drivable in said hollow interior of said toner conveyance container;

a developing device positioned laterally of the photoconductive drum, for forming toner images on the circumferential surface of the photoconductive drum, and for storing toner conveyed by said recovered-toner conveying device; and said cleaning unit and said recovered-toner conveying device being joined in a position higher than said second junction between said toner collector and said recovered-toner conveying device, and said toner conveyance container having at least an inner circumferential bottom-surface junction with said cleaning unit to said second junction with said toner collector, said toner conveyance container being inclined at an angle of 10 to 30 degrees above horizontal.

2. A photocopier toner recovery device for use in a photocopier employing a vertical sheet-conveyance configured to utilize a drum-lateral roller to conduct drum-to-sheet photoconductive image transfer onto vertically conveyed copy sheets, said photocopier toner recovery device comprising:

a cleaning unit configured to remove toner from a photoconductive drum; and a toner-conveying device configured between said cleaning unit and a developing unit, said toner-conveying device configured to receive toner removed by said cleaning unit and to discharge toner in said developing unit, said toner-conveying device including a container having a hollow interior, a hollow opening configured to communicate with said cleaning unit, and a discharge port configured to communicate with said developing unit, said hollow interior being inclined at an angle of approximately 10 to 30 degrees above horizontal, and a conveying member configured to rotate within said container to transport toner from said hollow opening to said discharge port, such that toner from the cleaning unit is discharged onto toner mixing rollers in said developing unit arranged below said discharge port.

* * * * *